United States Patent [19]

Stollenwerk

[11] Patent Number: 4,921,295

[45] Date of Patent: May 1, 1990

[54] CARRIAGE FOR AN AMBULANCE STRETCHER

[75] Inventor: Joachim Stollenwerk, Cologne, Fed. Rep. of Germany

[73] Assignee: Stollenwerk Fabrik für Sanitätsausrüstungen Hans Stollenwerk & Cie GmbH & Co., Fed. Rep. of Germany

[21] Appl. No.: 256,751

[22] Filed: Oct. 12, 1988

[30] Foreign Application Priority Data

Oct. 15, 1987 [DE] Fed. Rep. of Germany ..... 3734902

[51] Int. Cl.[5] ..... A61G 1/02

[52] U.S. Cl. ..... 296/20; 5/81 R

[58] Field of Search ..... 296/19, 20; 5/81 R, 5/81 B

[56] References Cited

U.S. PATENT DOCUMENTS

| | | | |
|---|---|---|---|
| 3,082,016 | 3/1963 | Pratt | 296/20 X |
| 4,037,871 | 7/1977 | Bourgraf et al. | 296/20 |
| 4,192,541 | 3/1980 | Ferneau | 296/20 |
| 4,405,172 | 9/1983 | Ferneau | 296/20 |

*Primary Examiner*—Margaret A. Focarino
*Assistant Examiner*—Gary C. Hoge
*Attorney, Agent, or Firm*—Neil F. Markva

[57] ABSTRACT

The entry rolls of a carriage for an ambulance stretcher are arranged at the carriage frame in such a manner that they are displaceable in lengthwise direction to the frame. At the front end of the carriage frame, the entry rolls can be locked by an arresting mechanism in a predetermined position relative to the frame. By releasing the arresting mechanism when the carriage is thrust into the transport vehicle, the entry rolls are shifted backwardly with respect to the frame toward the front legs until they are finally arranged directly under the front rollers of the ambulance stretcher disposed on the carriage.

15 Claims, 6 Drawing Sheets

CARRIAGE FOR AN AMBULANCE STRETCHER

FIELD OF THE INVENTION

The present invention is directed to a carriage for an ambulance stretcher.

BACKGROUND OF THE INVENTION

By such a carriage, an ambulance stretcher can be easily rolled to the site of an accident or, with the patient lying on the ambulance stretcher, to the ambulance car. The ambulance stretcher, being arranged on the frame of the carriage, is thrust onto the stretcher support rack within the ambulance car along with the carriage. During this procedure, the carriage first has its two entry rolls, which are fixedly attached to the front end of the frame, resting on the rear end of the stretcher support rack. When the carriage is pushed farther into the ambulance car, the front and rear legs, being articulated to the frame, are swivelled from the rear edge of the stretcher support rack up to the frame.

While placing the carriage onto the stretcher support rack, the entry rolls at the front end of the carriage are useful because the carriage with its entry rolls firmly rests on the stretcher support rack when the front legs swivel upwardly and do not support the carriage against the ground anymore. The entry rolls, however, project farther into the interior of the ambulance car than the rollers supported at the ambulance stretcher. Since conventional stretcher support racks are designed for shifting only the ambulance stretchers thereupon, their guide rails for receiving the rollers are shorter than is required for shifting a carriage onto said racks. Therefore, using the known carriages necessitates at least an alteration, i.e.. lengthening the stretcher support rack and, as circumstances require, even complete exchange of the stretcher support rack in the ambulance car.

PURPOSE OF THE INVENTION

The primary object of the invention is to provide a carriage for an ambulance stretcher having a frame, front and rear legs articulated to the frame and adapted to be arrested which stretcher does not require an adapted or altered stretcher support rack.

SUMMARY OF THE INVENTION

According to the invention, this object is solved by guiding entry rolls mounted to be displaced in lengthwise direction to the frame and at the front end of the path of displacement. Arresting means lock the rolls with regard to the frame.

In the carriage according to the invention, the entry rolls are not fixedly attached to the frame but are guided at the frame for lengthwise displacement. At the front end of the path of displacement of the entry rolls, where the entry rolls are arranged at the level of the front end of the frame, they can be arrested with regard to the frame by an arresting means operable and releasable e.g. by hand.

In the arrested state, the entry rolls are arranged at the front end of the displacement path when the carriage is shifted onto the rear end of the stretcher support rack which has been pulled out of the ambulance car. There is a maximum distance between the entry rolls and the swivelling axis of the front legs at the frame. Thus, the carriage has its entry rolls reliably resting on the stretcher support rack when the front legs, upon contacting the rear edge of the stretcher support rack, are swivelled upwardly. At this moment, the carriage rests on the stretcher support rack by its entry rolls while the rear legs are standing on the ground; therefore, the carriage stands safely.

When the carriage is pushed farther up and onto the stretcher support rack, the arresting means is released so that the entry rolls are not fixed anymore with regard to the frame. In this manner, the carriage can be shifted still farther into the ambulance car even when the entry rolls touch the front end of the stretcher support rack because, at this time, the entry rolls are displaced with regard to the frame, i.e. when the stretcher has been completely shifted into the ambulance car, the front end of the frame projects beyond the entry rolls. Since the entry rolls are guided at the frame to be displaced in lengthwise direction, the carriage is adjusted to the length of conventional stretcher support racks. Thus, a stretcher support rack which is designed for receiving an ambulance strecher only can be used for receiving the carriage according to the invention. Modifying the stretcher support rack is not necessary.

The carriage according to the invention meets two requirements: First, upon placing the carriage on the stretcher support rack, the distance between entry rolls and front legs must be large so that safe support of the carriage is provided while the frame is not supported anymore by the front legs when these are pivoted upwardly. Since the entry rolls can be displaced in lengthwise direction with regard to the frame, there is fulfilled also the second requirement of maintaining the stretcher support rack unaltered, i.e. exactly as short as before. Namely, when the carriage has been fully inserted into the ambulance car, the entry rolls are arranged directly below the front rollers of the ambulance stretcher, i.e. retracted with regard to the front end of the carriage frame. This is avantageous because the stretcher support racks which are already now mounted in ambulance cars can also be used for the carriage according to the invention, and the space available, especially for the assistant in the ambulance car, is not reduced.

Preferably, the entry rolls are resiliently biased towards the front end of their sliding path. Therefore, when the carriage is pulled out, the entry rolls automatically return to their position at the front end of the frame where they are arrested again by the arresting means.

According to an advantageous embodiment of the invention, the arresting means is coupled with an arresting means for locking the front legs. This makes it easier to handle the carriage since the arresting means for the entry rolls can be operated in connection with the arresting means for the front legs. Preferably, only one operating lever is provided for both arresting means. It is useful if the arresting means for the entry rolls secures the entry rolls against displacement and the front legs against swivelling movement at the same time.

Advantageously, the entry rolls are safeguarded against sliding movement at the rear end of their sliding path when the front legs have been swivelled up to the frame. In this position, the entry rolls are arranged at the level of the front rollers of the ambulance stretcher and directly below said rollers. Thus, the collapsed carriage is supported more safely on the stretcher support rack because the frame cannot be displaced anymore with regard to the entry rolls resting on the rack.

In another advantageous embodiment of the invention, the entry rolls are rotatably mounted at both ends of an axle extending transversely to the frame, said axle being connected to a first sliding member which is guided to be displaced in a hollow profile strip extending lengthwise to the frame and can be locked by the arresting means. In this embodiment, the frame consists substantially of two longitudinal bars and a hollow profile strip extending between and parallel to the longitudinal bars, in which hollow profile strip a first sliding member is displaceably guided and connected to an axle which is arranged transversely to and under the frame, an entry roll being rotatably mounted at each end of said axle. The hollow profile strip is provided with at least one downwardly opened channel in which the sliding member is undetachably arranged. By the hollow profile strip, the whole frame is given a compact structure and thus obtains the necessary strength. The arresting means is arranged at the hollow profile strip. The stability of the frame and thus of the whole carriage is even further enhanced if the transverse axle is borne from below by support rollers against both longitudinal bars. Thereby, lateral tilting movements are largely excluded when the carriage, by the support rollers, rests on the stretcher support rack.

In another advantageous embodiment of the invention, supporting rods are pivotably mounted to the front legs, which supporting rods are movably connected to a second sliding member which is displaceable in the hollow profile strip and can be locked by the arresting means. The arresting means locks the second sliding member when the front legs have been swivelled downwardly and locks the first sliding member for the entry rolls when the front legs have been swivelled up to the frame. Thus, a single arresting means for securing the entry rolls against lengthwise displacement and securing the supporting rods against lengthwise displacement, i.e. securing the front legs against swivelling, is realized in a simple manner.

In another embodiment of the invention, the first sliding member abuts the second sliding member and the front end of the hollow profile strip when the front legs have been swivelled downwardly and arrested and that the second sliding member abuts the firsat sliding member when the front legs have been swivelled up to the frame. By locking one sliding member, respectively, by the arresting means, also the other sliding member, not being engaged by the arresting means, is secured against displacement at the same time.

A prefered embodiment of the invention provides that the front legs have supporting rods pivotably mounted thereto which are connected to the entry rolls. The supporting rods, which are displaced with regard to the frame when the front legs are swivelled, are connected to the axle supporting the entry rolls. Thus, the entry rolls are displaced automatically with regard to the frame when the front legs are being swivelled upwardly upon thrusting the carriage into the ambulance car. In this manner, a positive coupling between the swivelling of the legs and the displacement of the entrance rolls is established.

Advantageously, the supporting rods are movably connected to the first sliding member which in turn is connected to the axle of the entry rolls and is displaceaby guided in the hollow profile strip. When the entry rolls are in a position at the front end of the path of displacement and are secured against being displaced, the front legs are in a swivelled-down position and are locked as well. When the front legs are swivelled up to the frame, the entry rolls, due to the positive coupling of the supporting rods to the entry rolls, are arranged at the rear end of the path of displacement. Also in this position of the front legs and the entry rolls, these elements are secured against movement by the arresting means.

Preferably, the entry rolls are connected to a stop element which cooperates with a locking member arranged at the stretcher support rack, said locking member preventing motion of the entry rolls back towards the front end of the sliding path. Upon shifting the carriage onto the stretcher support rack, the stop element touches a locking member, e.g. a hook arranged at the stretcher support rack. When the carriage is shifted farther onto the stretcher support rack, the frame is displaced with regard to the entry rolls. Thereby, the entry rolls are brought into their position at the rear end of the displacement path. In this manner, the entry rolls automatically reach the position at the rear end of the displacement path when the carriage is thrust into the ambulance car. Also the front end of the stretcher support rack can serve as the locking member, the entry rolls abutting against said front end when the carriage is loaded into the car.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
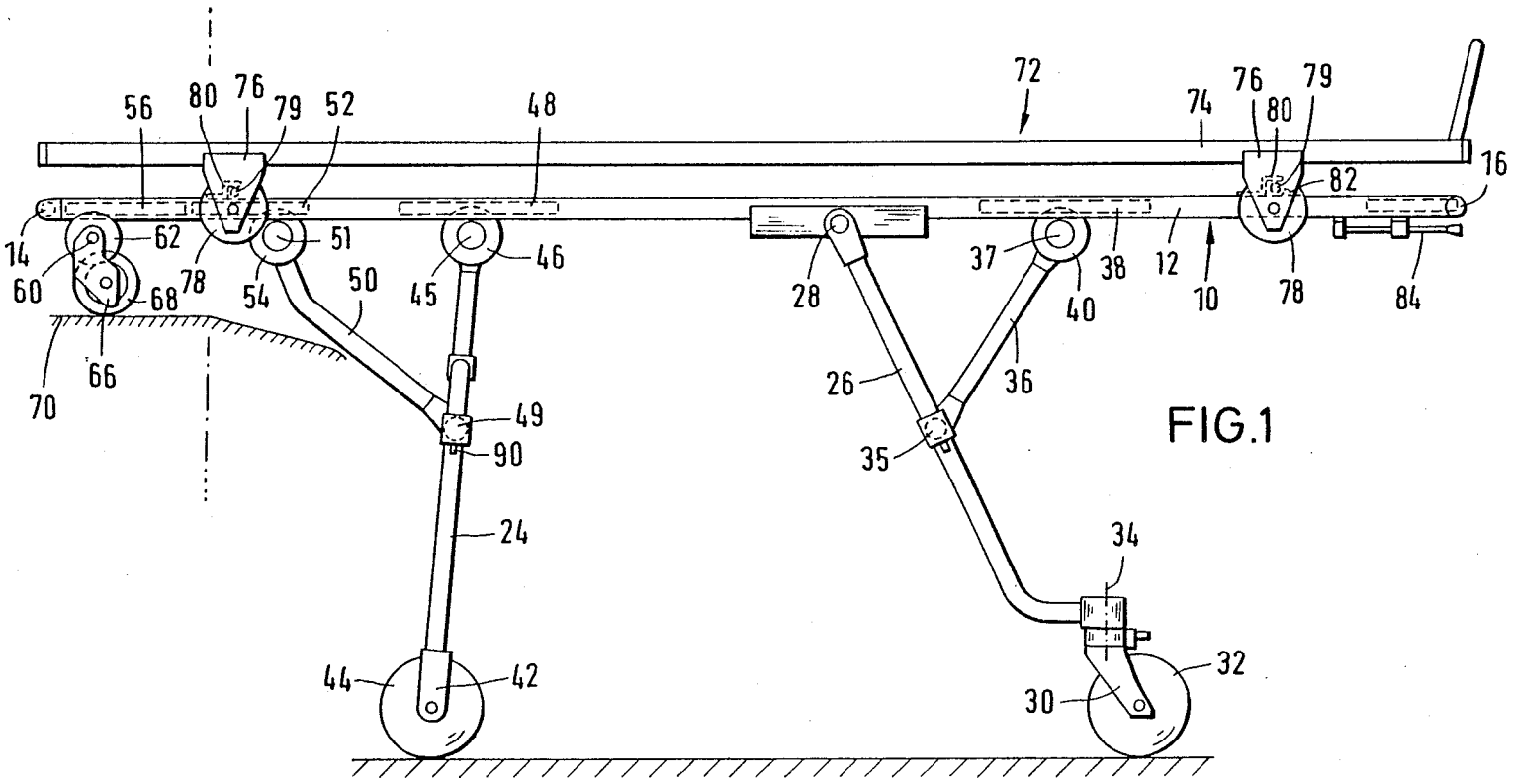
FIG. 1 is a side view of the carriage with the ambulance stretcher arranged thereon.
Figure 4:
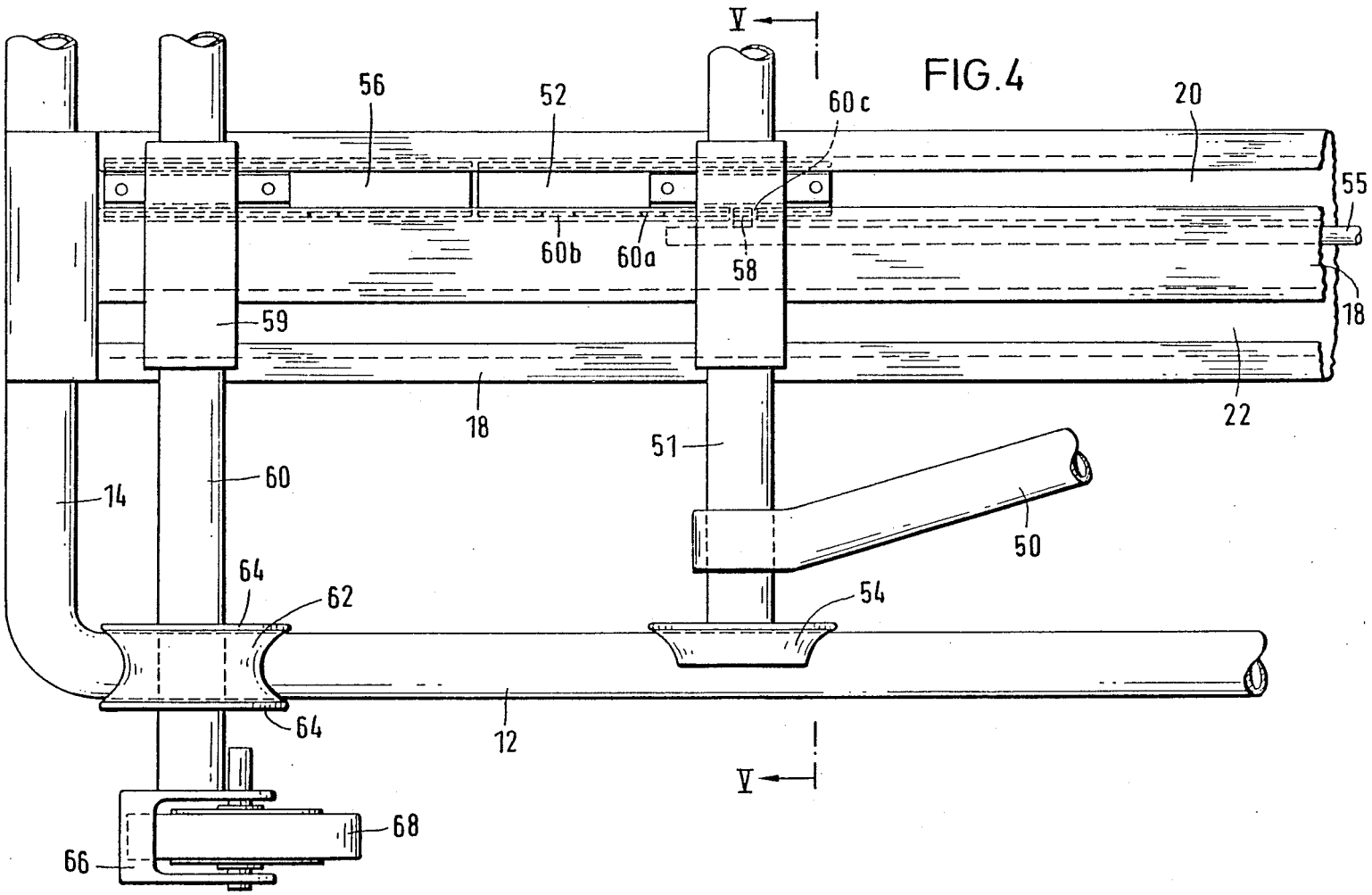
FIG. 4 is a partial bottom view of the carriage in the direction of the arrows IV in FIG. 3.

FIG. 1 shows the carriage with the ambulance stretcher 72 arranged thereon, the legs 24 and 26 being swivelled down and arrested. The carriage includes a frame 10 consisting of two longitudinal bars 12 of round section (only one of them shown in the drawing), a front transverse bar 14 and a rear transverse bar 16. A hollow profile strip 18 (FIGS. 4 and 5) extends parallel to the longitudinal bars 12, its two ends being connected to said transverse bars 14 and 16. The hollow profile strip 18 includes two substantially circular channels 20 and 22 extending in parallel to the longitudinal bars 12 and being open downwardly. In the channels 20 and 22, a plurality of sliding members 38, 48, 52 and 56, shaped as short tubes, are displaceable as decribed later on. Each channel 20 and 22 includes a closed wall extending over an angular range of about 270° such that sliding members 38, 48, 52 and 56 are supported undetachably.

The frame 10 has two front legs 24 and two rear legs 26 pivoted thereto, only one leg of each pair being shown in the drawings. The rear legs 26 are articulated directly at the longitudinal bars 12 by joints 28. At the end of each rear leg 26, there is arranged a bifurcated support 30 with a wheel 32 rotatably mounted thereat. Said supports 30 are fastened to the legs 26 so as to be rotatable about a vertical axis 34. Thus, wheels 32 are the caster wheels of the carriage.

Both rear legs 26 are connected to each other by a crossbar 35. Supporting rods 36 are pivotably fastened to crossbar 35. The two free ends of supporting rods 36 are interconnected by an axle 37 which is connected to a sliding member 38 arranged within channel 22 of the hollow profile strip 18. To both ends of axle 37, there is fastened a support roller 40, said support rollers 40 abutting to the longitudinal bars 12 from below and, when the rear legs 26 are swivelled, roll along longitudinal bars 12. Sliding member 38 can be separately arrested and released in channel 22 by an arresting means which is not described in detail. Said arresting means is actuated by a lever at the rear end of frame 10.

Both of the two front legs 24 have a bifurcated support 42 fixedly attached to their lower ends, each of which bifurcated supports rotatably holds a wheel 44. The two upper ends of front legs 24 are connected by an axle 45 extending transversely to frame 10. At both ends of axle 45, there is arranged a support roller 46 abutting the lower sides of longitudinal bars 12. The axle 45 of the two support rollers 46 is connected to a sliding member 48 which is displaceable within channel 20 of hollow profile strip 18. The two front legs 24 are interconnected by a crossbar 49 which in turn has two supporting rods 50 pivotably mounted thereto. In the same manner as the two supporting rods 36 for the rear legs 26, the two supporting rods 50, through a transverse axle 51 (FIGS. 4 and 6), are connected to a second sliding member 52 which is undetachably arranged in channel 20 and can be displaced in lengthwise direction. At each end of the axle interconnecting both supporting rods 50, there is rotatably mounted a support roller 54. The support rollers 54 abut against the longitudinal bars 12 from below in the same fashion as support rollers 46 and 40.

The second sliding member 52 can be locked in channel 20 of hollow profile strip 18 by an arresting means. Said arresting means consists of a rod 55 (FIG. 4) which extends parallel to channels 20 and 22 and is rotatably arranged in hollow profile strip 18. At the rear end of rod 55, there is arranged an operating lever (not shown) which is arranged below the rear transverse bar 16 of frame 10 and is operable by hand. A locking hook 58 is fastened to the front end of rod 55. When the second sliding member 52 is locked, locking hook 58 projects into a recess 60 in the second sliding member 52. Rod 55 is biased in such a manner that, when the operating lever is not operated, locking hook 58 is in the locking position for locking the sliding member 52. When rod 55 is operated, it is turned against the biasing force.

Figure 5:
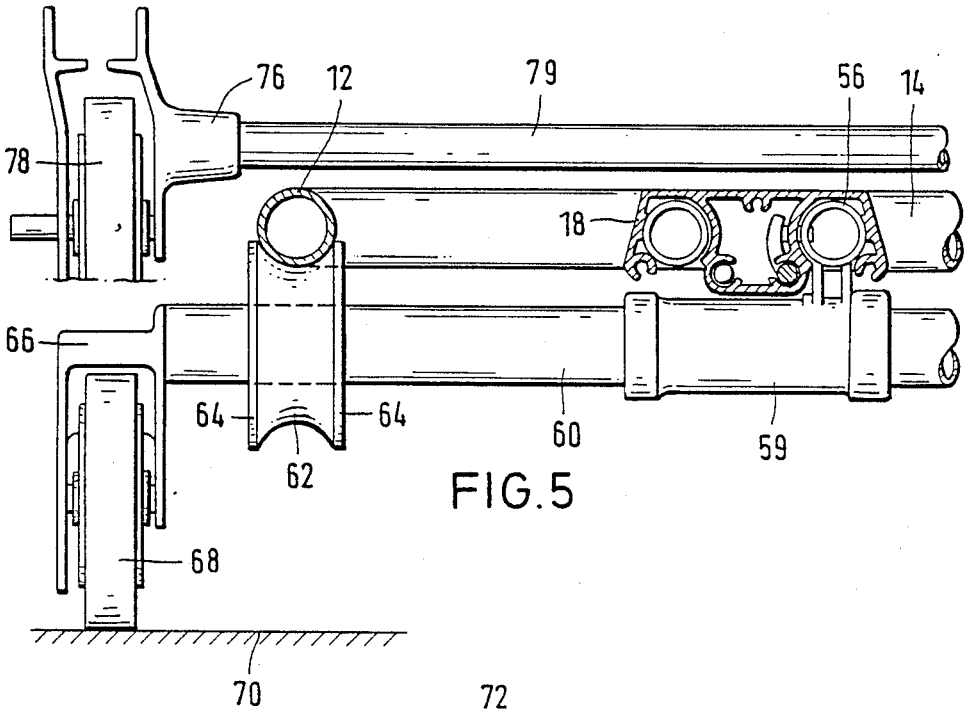
FIG. 5 is a sectional view along the line V—V of FIG. 4.

Between the second sliding member 52 and the front end of hollow profile strip 18, which is connected to transverse bar 14 a first sliding member 56 is located in channel 20 in such a manner that it can be displaced and arrested like the second sliding member 52. The first sliding member 56 is connected to a sleeve 59 fastened to axle 60 extending transversely to frame 10. Axle 60 is arranged below frame 10 and projects beyond the longitudinal bars 12 at both sides (FIG. 5). Two support rollers 62 are rotatably mounted to axle 60, abut against the longitudinal bars 12 from below and, when axle 60 is displaced, roll along longitudinal bars 12. Each support roller 62 includes a flange 64 at both sides, and the shape of the rolling surface is adapted to the round longitudinal bars 12. By said two flanges 64 and the special arrangement of the rolling surfaces of support rollers 62, the support rollers 62 are secured against lateral movement, thus abutting always against the longitudinal bars 12 from below.

To each of both ends of axle 60 protruding laterally beyond longitudinal bars 12, there is fastened a bifurcated support 66 with its opening directed downwardly. In each support 66, an entry roll 68 is rotatably mounted. The carriage, when being shifted into the ambulance car, rests on the stretcher support rack 70 through said entry rolls 68. Since axle 60, being connected to said supports 66 for the entry rolls 68, is supported at the longitudinal bars 12 through support rollers 62 and within hollow profile strip 18 through sliding member 56, the position of the entry rolls 68 can be displaced in lengthwise direction with regard to frame 10.

The ambulance stretcher 72 rests on the frame 10 of the carriage. The ambulance stretcher 72 includes two longutudinal bars 74 each having two downwardly opened bifurcated supports 76 fixedly attached thereto. The four rollers 78 of the ambulance stretcher 72 are pivotably supported at said supports 76. The two front supports and the two rear supports, respectively, are interconnected by a rod 79 extending transversely to the lengthwise direction of ambulance stretcher 72, said rod 79 resting on the hollow profile strip 18 and both longitudinal bars 12 from above. Both rods 79 are arranged below holding-down devices 80 set onto the hollow profile strip 18 from above. The ambulance stretcher 72 can be fixed to the frame 10 in the position shown in the drawings by a locking hook 82 which is supported to be pivoted within hollow profile strip 18 by an operating lever 84 at the rear end of frame 10 and projects upwards through an opening. Locking hook 82 is advantageously arranged as a catcher for arresting the rear rod 79 so that the ambulance stretcher 72 is automatically locked when being shifted onto frame 10.

Subsequently, operation of the carriage is explained in greater detail.

Figure 3:
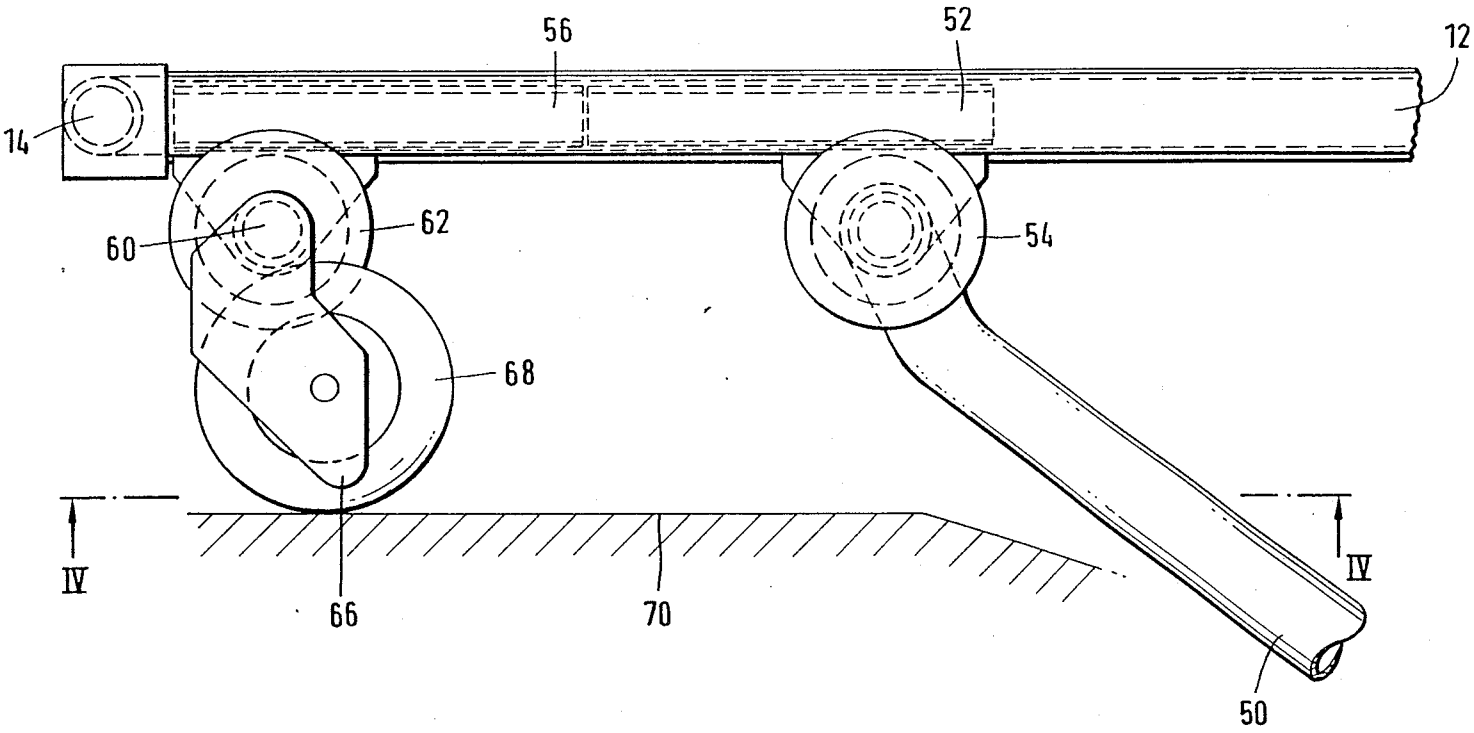
FIG. 3 is an enlarged side view of the front portion of the carriage according to FIG. 1.

For thrusting the carriage into the ambulance car, the carriage is first shifted from the rear against the stretcher support rack 70 in the ambulance car, as FIG. 1 shows. When legs 24 and 26 are swivelled down, the entry rolls 68 are in a position at the front end of frame 10. When the front legs 24 are swivelled down, the first sliding member 56, connected to the entry rolls 68 by supports 66 and axle 60, is tightly enclosed between the front end of hollow profile strip 18 and the second sliding member 52. In the arrested state of front legs 24, the second sliding member 52, connected to the supporting rods 50 for the front legs, is arrested in channel 20 of hollow profile strip 18 by locking hook 58. Thus, also the enclosed first sliding member 56 is immovable so that the entry rolls 68 are secured against displacement at the front end of frame 10, i.e. at the front end of their path of displacement (cf. FIGS. 1, 3 and 4).

When the carriage is shifted into the ambulance car, frame 10 first rests on the stretcher support rack 70 through entry rolls 68. Depending on the specific embodiment, the stretcher support rack 70 is provided with a receiving platform adapted to be lowered; first, the entry rolls 68 roll on said receiving platform. As soon as the entry rolls 68 are supported on stretcher support rack 70, the ambulance man can release the arresting means for the second sliding member 52 using a lever (not shown) at the rear end of frame 10. The carriage, not being supported anymore by front legs 24, is now supported on stretcher support rack 70 by entry rolls 68 and on the ground by rear legs 26 which are further arrested at frame 10. In the unlocked condition of front legs 24, firm support of the carriage on stretcher support rack 70 is obtained because the distance between the entry rolls 68 and the front supporting rods 50 is comparatively large, which is guaranteed by the entry rolls 68 being arranged at the front end of frame 10 when starting to shift the carriage onto stretcher support rack 70.

When the carriage is shifted farther into the transport car, the front supporting rods 50 abut against the rear edge of stretcher support rack 70. thus, supporting rods 50 are displaced with regard to frame 10, with the support rollers 54 rolling along the underside of longitudinal bars 12. Due to the displacement of the front supporting rods 50, said rods 50 swivel the front legs 24 up to frame 10. When the front legs 24 are swivelled, the second sliding member 52 is unlocked, and accordingly, also the first sliding member 56 is not arrested anymore at hollow profile 18. Therefore, the entry rolls 68 can be longitudinally displaced with regard to the frame away from the front end of frame 10 in the direction of the front legs 24 while rolling on stretcher support rack 70.

As soon as the rear edge of stretcher support rack 70 abuts against the rear legs 26 when the carriage is pushed farther into the transport car, rear legs 26 are unlocked by releasing the separate arresting means provided for arresting the sliding member 38 of the rear supporting rods 36. Thus, also the rear legs 26 are swivelled up to frame 10, and finally, the whole carriage is arranged on the stretcher support rack 70 with the legs 24 and 26 swivelled up. The entry rolls 68 abut against stoppers 85 arranged upright at the front end of the stretcher support rack 70 stoppers 85 "catch" the entry rolls 68 and, when the carriage is pushed into the transport car, shift them back with respect to the frame 10.

Figure 2:
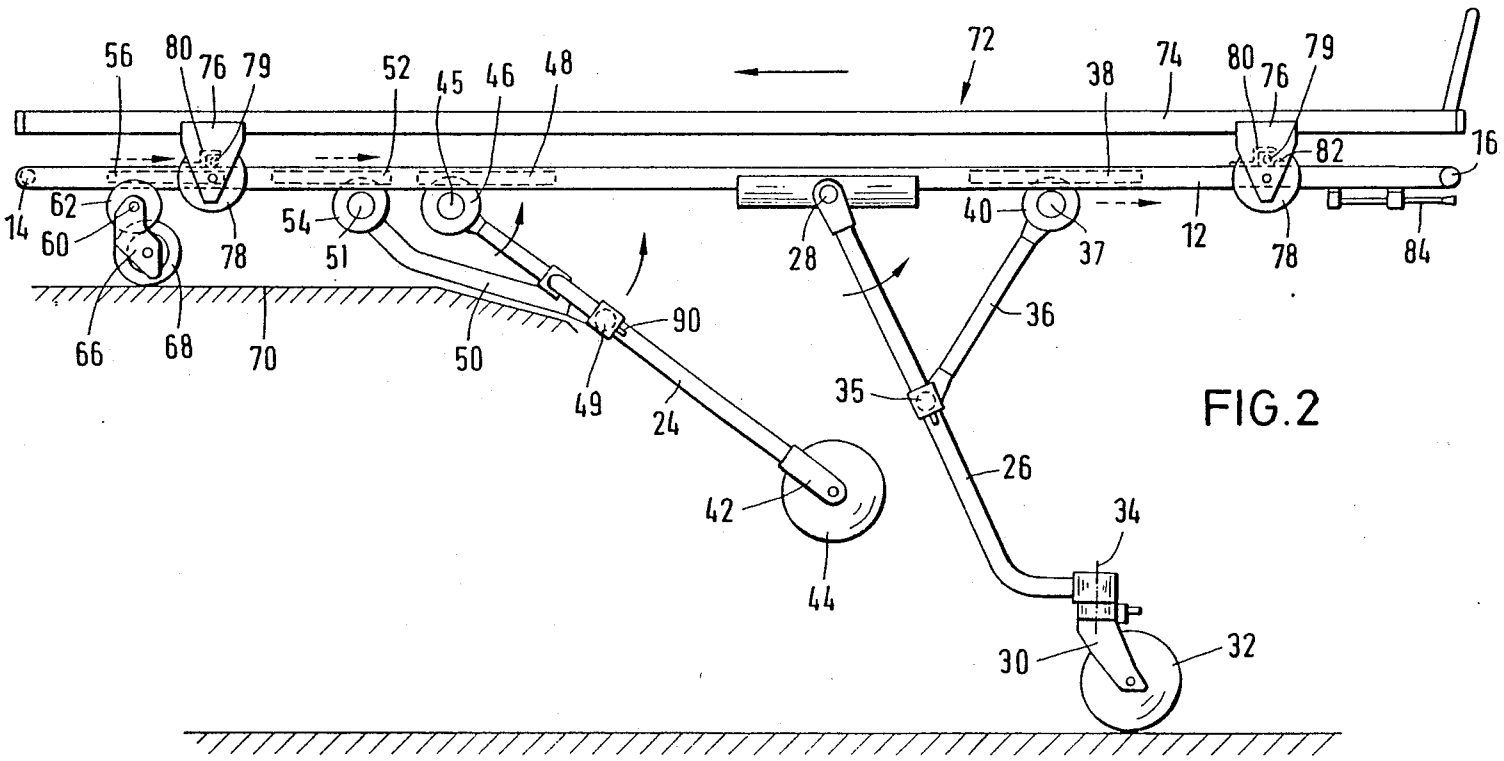
FIG. 2 is a side view of the carriage partially shifted onto the stretcher support rack.

Instead of said stoppers 85, also locking members can be provided for engaging stoppers which are provided at supports 66 of entry rolls 68 or at axle 60. The arrows in FIG. 2 indicate the directions in which the front and the rear legs 24 and 26 as well as the front and the rear supporting rods 50 and 36 are swivelled or, respectively, in which the front and the rear supporting rods 50 and 36 as well as the entry rolls 68 are displaced.

Figure 7:
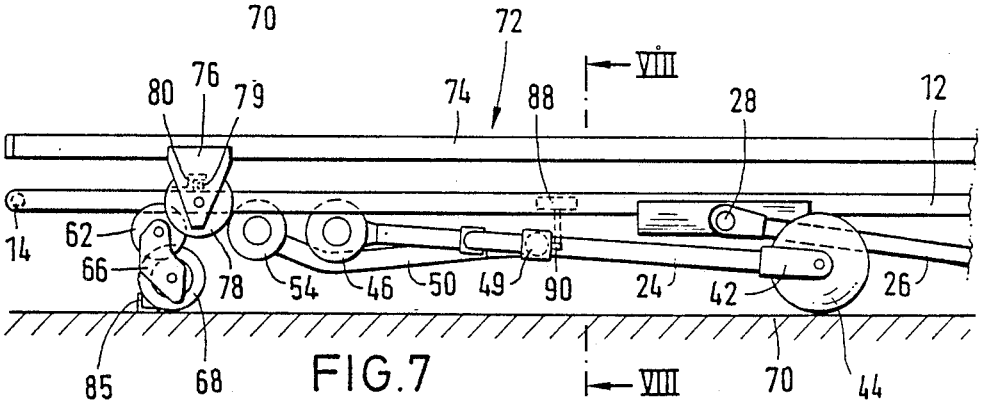
FIG. 7 is a side view of the collapsed carriage arranged on the stretcher support rack.
Figure 6:
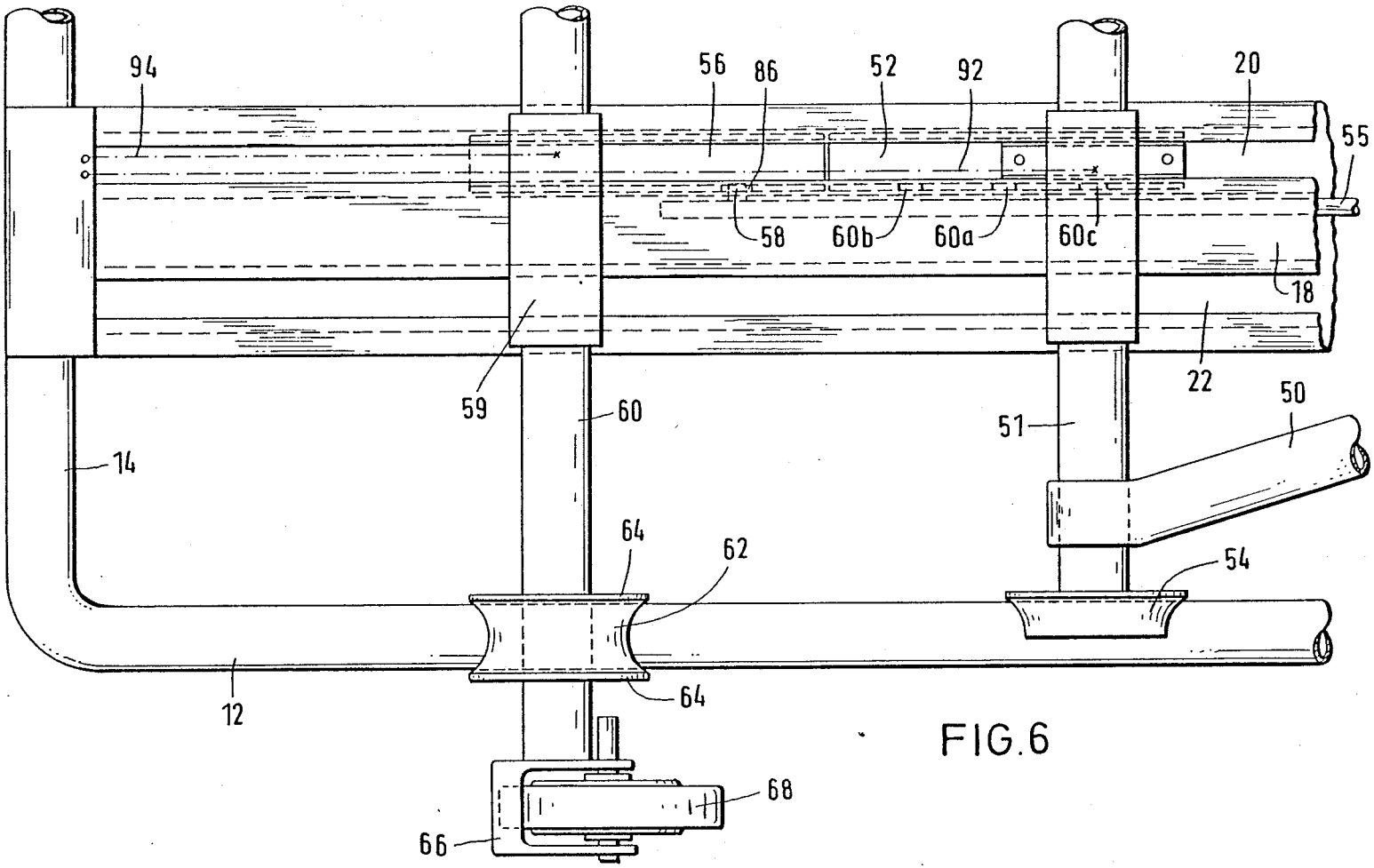
FIG. 6 is a partial bottom view of the front portion of the carriage similar to FIG. 4 with the entry rolls arranged at the rear end of their path of displacement.

FIGS. 6 and 7 show the position which is maintained by the entry rolls 68 when the carriage completely rests on the stretcher support rack 70. The entry rolls 68 are arranged at the front end of stretcher support rack 70 and, with regard to the frame 10, directly below the front rollers 78 of ambulance stretcher 72. This means that, while the carriage has been pushed into the transport car, the entry rolls 68 have been displaced with regard to frame 10 from the front end of frame 10 to the level of the front rollers 78 of ambulance stretcher 72, i.e. to the rear end of their displacement path. Thus, the entry rolls 68 are arranged exactly in the position where also the front rollers 78 of ambulance stretcher 72 are arranged when said ambulance stretcher has been pushed onto the stretcher support rack 70 without a carriage. Thus, the stretcher support rack 70 need not be altered or extended for the carriage.

In the position of the entry rolls 68 shown in FIGS. 6 and 7, the first sliding member 56 is locked by the locking hook 58 which before, with the front legs 24 swivelled down, had locked the second sliding member 52 of front support rods 50 and thus had arrested the front legs 24 at the frame 40. The first sliding member 56 has a recess 86 formed therein into which the locking hook 58 penetrates when the entry rolls 68 are secured against displacement at the rear end of their displacement path. The second sliding member 52 has its one side abutting to the first sliding member 56.

Figure 8:
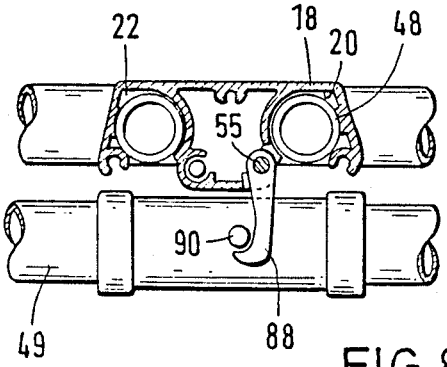
FIG. 8 is a sectional view along the line VIII—VIII of FIG. 7.

In their swivelled-up position, front and rear legs 24, 26 are held under frame 10 by catching hooks 88 which are coupled to the respective arresting means for the front and rear legs. In FIGS. 7 and 8, there is shown the catching hook 88 for the front legs 24. Said catching hook 88 projects downwardly out of hollow profile strip 18 and is fastened to rod 55, at which rod 55 there is also arranged the locking hook 58 for locking the first and the second sliding members 56 and 52, respectively. Thus, catching hook 88 is swivelled via rod 55. Catching hook 88 embraces a pivot 90 arranged at crossbar 49 connecting both front legs 24. Pivot 90 extends in parallel to front legs 24. By the catching hook 88 engaging pivot 90, the front legs are held or "caught" under frame 10.

When the carriage is pulled out of the transport car and the first sliding member 56 is being unlocked by turning rod 55, also the front legs 24 are released. The front legs 24 fall down by their own weight when the carriage is pulled out. The last part of this swivelling movement is enhanced by a torsional spring arranged between the second sliding member 52 and the front end of hollow profile strip 18. Said torsional spring moves the second sliding member 52 back to its original position. In FIG. 6, the torsional spring is schematically indicated by the chain-dotted line 92. There is also a torsional spring arranged between the first sliding member 56 and the front end of hollow profile strip 18; this torsional spring is also schematically indicated by the chain-dotted line 94 of FIG. 6.

When the carriage is pulled out of the transport car, torsional spring 94 moves sliding member 56 into its original position in which the entry rolls 68 are arranged at the front end of their path of displacement, i.e. at the front end of frame 10. Thus, the entry rolls 68 are moved back on the one hand by the second sliding member 52 when the front legs 24 are swivelled downwardly, which second sliding member 52 abuts against the first sliding member 56 and moves the latter towards the front end of hollow profile strip 18, and on the other hand by the torsional spring 94, which has been tensioned upon thrusting the carriage into the ambulance car. With the front legs 24 swivelled down, the locking hook 58 again penetrates into the recess 60 of second sliding member 52, whereby second sliding member 52 and thus the front legs are arrested. For the case that the front legs, due to a too small distance of frame 10 to the ground, do not perform the complete swivelling motion when the carriage is pulled out, a plurality of recesses **60*c* and 60*a*, 60*b* are provided in second sliding member 52. In any case, the locking hook 58 will penetrate into one of these recesses, thus locking sliding member 52 and accordingly the front legs 24**.

The carriage can also be brought into a lowered shock position while standing on the legs. For this purpose, an arresting means (not shown), engaging sliding member 48 of the front legs 24 and operable by a lever at the front end of frame 10, has to be released. When said arresting means is released, front legs 24 are swivelled with regard to frame 10 and the front support rods 50 while the support rollers 46 travel along the underside of longitudinal bars 12. The front legs 24 move towards the rear legs 26 by a certain distance, thus lowering the front end of the frame. When the carriage is in a lowered state, the front legs 24 can be arrested at frame 10 by sliding member 48.

While the carriage for an ambulance stretcher has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A carriage for an ambulance stretcher, said carriage comprising:

(a) a frame, front and rear legs articulated to the frame and adapted to be arrested, (b) means mounting entry roller means at the front end of the frame, (c) said mounting means including guide means for displacing the entry roller means in lengthwise direction along the frame between a front end position and a displaced position, and (d) arresting means for locking the entry roller means in a predetermined position with respect to the frame.

2. A carriage according to claim 1 wherein said entry roller means includes two entry rolls.

3. A carriage according to claim 1 wherein the arresting means includes means for locking the front legs in a predetermined position.

4. A carriage according to claim 1 wherein the arresting means in a first locked condition secures the entry roller means against sliding movement within a front end position and the front legs against swivelling movement at the same time.

5. A carriage according to claim 1 wherein said guide means includes sliding means which slide along strip means defining a sliding path, said sliding means move between said front end position and said displaced position along said path, said arresting means secures the entry roller means (i) against sliding movement at the front end position of the sliding path when the front legs have been swivelled downwardly, and (ii) against sliding movement at a rear end displaced position of the sliding path when the front legs have been swivelled up to the frame.

6. A carriage according to claim 1 wherein the mounting means includes means resiliently biasing the entry roller means toward the front end position of the sliding path.

7. A carriage according to claim 1 wherein the frame includes two longitudinal bars, and said mounting means includes support rollers for bearing the entry roller means from below the longitudinal bars.

8. A carriage according to claim 1 wherein the mounting means includes an axle extending transversely to the frame, the entry roller means includes a roll rotatably mounted at each end of said axle, said guide means includes a first sliding member displaceably mounted in a hollow profile strip extending lengthwise to the frame, the arrresting means includes means for locking the first sliding member in a predetermined position in the hollow strip, and said axle is connected to the first sliding member.

9. A carriage according to claim 8 wherein supporting rods are pivotably mounted to the front legs and movably connected to a second sliding member displaceably mounted to slide in the hollow profile strip, and the arresting means lock the second sliding member in a predetermined position in the hollow strip.

10. A carriage according to claim 9 wherein the arresting means locks the second sliding member when the front legs have been swivelled downwardly and locks the first sliding member connected to the entry rolls when the front legs have been swivelled up the frame.

11. A carriage according to claim 1 wherein the guide means includes a first and second sliding members displaceably mounted in a hollow profile strip extending lengthwise to the frame, the first sliding member abuts the second sliding member and the front end of the frame when the front legs are swivelled downwardly and arrested, and the second sliding member abuts the first sliding member when the front legs are swivelled up to the frame.

12. A carriage according to claim 1 wherein supporting rods are pivotably mounted to the front legs, said supporting rods are connected to move cooperatively with respect to the entry roller means.

13. A carriage according to claim 1 wherein the guide means includes a first sliding member displaceably mounted in a hollow profile strip extending lengthwise to the frame, and supporting rods for the front legs are pivotably mounted to the first sliding member.

14. A carriage according to claim 1 wherein position limiting means for the roller means includes a stop element which cooperates with a locking member arranged at a stretcher support rack, and said locking member prevents motion of the entry roller means back toward the front end of a sliding path for the roller means.

15. A carriage according to claim 1 wherein the arresting means includes a rod which extends parallel to a hollow profile strip extending lengthwise to the frame, said rod is pivotably supported and resiliently biased towards a locked condition, a radially projecting operating lever is fastened at an end of said rod at the rear end of the frame, and a locking hook is fastened at the other end of said rod.

* * * * *